United States Patent [19]

Smith

[11] Patent Number: 4,518,121

[45] Date of Patent: May 21, 1985

[54] BEAD DISPENSER FOR PAINT STRIPER

[75] Inventor: David H. Smith, Redwood City, Calif.

[73] Assignee: Binks Manufacturing Company, Franklin Park, Ill.

[21] Appl. No.: 414,005

[22] Filed: Sep. 2, 1982

[51] Int. Cl.[3] ..... B05B 1/28; B05B 7/02; B05B 9/01

[52] U.S. Cl. ..... 239/526; 239/306; 239/150

[58] Field of Search ..... 239/150, 151, 172, 306, 239/307, 286, 413, 420, 521, 526, 578; 222/517, 556

[56] References Cited

U.S. PATENT DOCUMENTS 1,999,563 11/1930 Glasgow ..... 239/150 X
2,136,123 3/1937 Baron ..... 222/517
3,057,273 10/1962 Wilson ..... 239/150 X
3,820,718 6/1974 Ammon ..... 239/150 X

*Primary Examiner*—Andres Kashnikow
*Assistant Examiner*—Kevin Patrick Weldon
*Attorney, Agent, or Firm*—Gary, Juettner & Pyle

[57] ABSTRACT

A reflective bead dispenser for use with an airless paint spray gun for marking traffic lines on pavement surfaces is connected to the spray gun by supporting a hollow tube in a passage through a handle of the gun. An inlet end to the tube is connected with a supply of reflective beads, an outlet end from the tube has a nozzle for dispensing reflective beads into a spray of paint emitted from the gun, and a valve controls a flow of beads through the tube. The beads are entrained in the paint spray and deposited along with the paint on the pavement surface to form a reflective stripe thereon.

9 Claims, 3 Drawing Figures

104
100
52
50
58
102
44
76
48
62
70
74
66
60
56
64
98
108
68
107
106

BEAD DISPENSER FOR PAINT STRIPER

BACKGROUND OF THE INVENTION

A portion of the present invention was accepted under the Disclosure Document Program of the U.S. Patent and Trademark Office on Oct. 16, 1981, under Identification No. 103547.

The present invention relates to paint stripers in general, and in particular to an improved spray gun and reflective bead dispenser assembly for use with paint stripers.

Paint stripers are employed for marking traffic lines on streets, roads, parking lots and other pavement surfaces. Conventionally, a paint striper comprises a wheeled cart having a push handle, on which is mounted a gasoline engine driven air compressor. A spray gun is carried to the side of the cart at the forward end thereof, and is connected with a supply of paint under pressure for airless spraying. A nozzle of the gun points downwardly for directing a spray of paint onto a pavement surface, and actuation of the gun may be controlled by a cable connected between a trigger on the gun and a control lever on the handle of the cart. In use, an operator pushes the cart, such that a guide at a forward end thereof follows the pavement where a stripe is to be painted, while selectively operating the control lever to actuate the gun and apply the stripe.

Although painted traffic lines show up well in daylight, they are often difficult to see at night, particularly when the pavement is wet. The art therefore contemplates the application of reflective traffic lines. To this end, a dispenser is provided in proximity with the spray gun on the cart for injecting reflective beads into the paint spray emitted from the gun. The beads become entrained in the spray, and are deposited therewith in a traffic line painted on the pavement. Because of the beads, the traffic lines are clearly visible even at night when the pavement is wet by virtue of the light being reflected from the headlights on vehicles. However, a drawback of conventional bead dispensing systems is that they usually require considerably additional structure for mounting the dispenser on the cart in proximity with the spray gun, which adds cost and complexity to the paint striper.

OBJECT OF THE INVENTION

The primary object of the present invention is to provide improved and simplified spray gun and bead dispenser assemblies for paint stripers.

SUMMARY OF THE INVENTION

In accordance with the present invention, an improved spray gun and bead dispenser assembly for a paint striper comprises an airless spray gun of the hand-held type having an inlet for connection with a supply of paint under pressure, a handle having a passage therethrough, a spray nozzle and a trigger for actuating the gun to emit a spray of paint from said nozzle. The assembly also includes a bead dispenser comprising a hollow tube extended through and supported in the gun handle passage, the tube having an inlet end for connection with a supply of reflective beads under pressure and an outlet end forwardly of the handle, valve means for controlling a flow of beads through the tube for emission from the outlet end thereof, and a deflector connected with the outlet end for deflecting beads emitted therefrom into a spray of paint from said spray gun.

The beads become entained in the paint, and are deposited with the paint in a stripe on a surface to be striped.

The foregoing and other objects, advantages and features of the invention will become apparent upon a consideration of the following detailed description, when taken in conjunction with the accompanying drawings.

DETAILED DESCRIPTION

Figure 1:
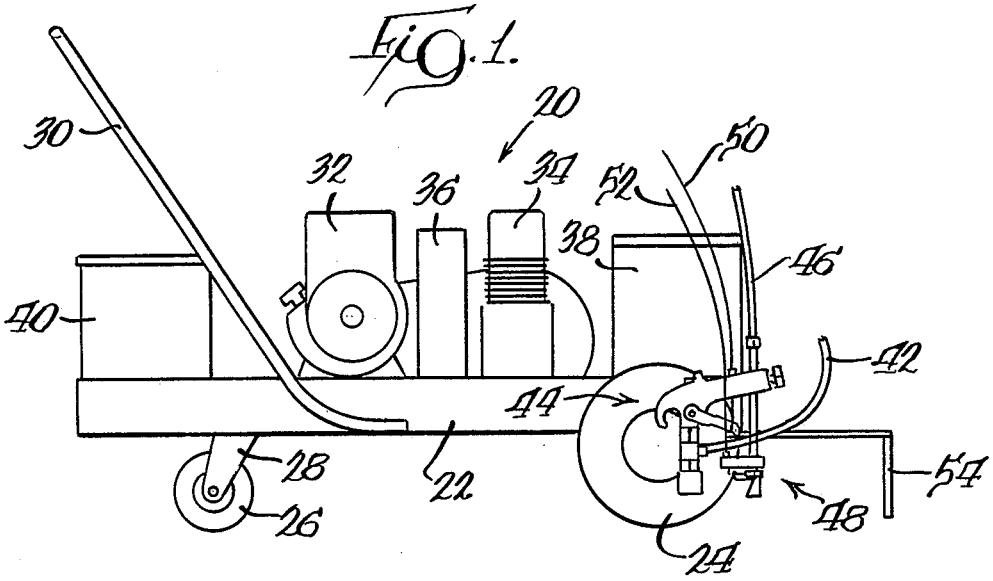
FIG. 1 is a simplified side elevation view of a paint striper having a spray gun and bead dispenser assembly, configured in accordance with one embodiment of the invention, carried thereon for applying reflective traffic lines on pavement.

In FIG. 1 there is indicated generally at 20 a paint striping apparatus of a type with which the improved spray gun and bead dispensing assemblies of the invention may advantageously be used. Since the majority of the paint striper does not form a part of the present invention, it is shown in simplified form and includes a cart 22 having a pair of wheels 24—24 at its forward end and a single wheel 26 mounted on a swivel bracket 28 at its rearward end, whereby the cart may readily be guided by an operator pushing a handle 30. Carried on the cart is a gasoline engine 32 for operating an air compressor 34, an outlet from which is connected with a receiver tank 36 for storing a supply of compressed air. An outlet from the receiver tank is coupled through appropriate pressure regulators and lines (not shown) with a paint supply container 38 and a reflective bead supply container 40 for pressurizing supplies of paint and beads. An outlet from the paint supply container is connected through a line 42 with an inlet to an airless spray gun, indicated generally at 44, and an outlet from the bead container is connected through a line 46 with an inlet to a bead dispenser, indicated generally at 48. To control actuation of the spray gun a cable 50, and to control actuation of the bead dispenser a cable 52, are connected to respective control levers (not shown) on the handle, or in the alternative the cables may be connected to a single control lever for simultaneous actuation of both the spray gun and bead dispenser.

The spray gun 44 and bead dispenser 48 are mounted by any suitable means at the forward end and to the side of the cart 22, and in use an operator pushes the paint striper by means of the handle 30 to guide a rod 54 along the pavement to where a paint stripe or traffic line is to be applied. The operator then moves the control lever or levers to selectively actuate the spray gun and bead dispenser and apply a reflective traffic line along selected portions of the pavement. In this connection, a nozzle of the spray gun is directed downwardly toward the pavement, and the bead dispenser projects beads into the paint spray, so that the beads become entained in the spray and are applied in a stripe on the pavement along with the paint. When the paint dries, the beads are bonded by the paint to the pavement in and along the stripe and reflect light from vehicle headlights, whereby the traffic lines are clearly visible at night.

Figure 2:
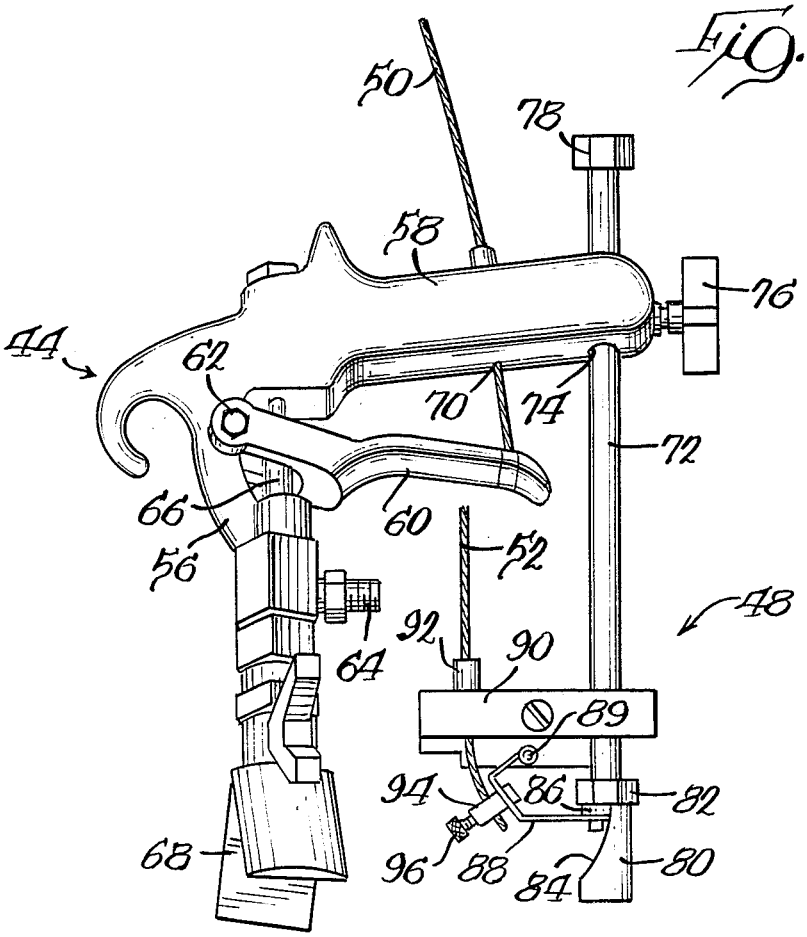
FIG. 2 is a side elevation view of a spray gun and bead dispenser assembly in accordance with the one embodiment of the invention.

FIG. 2 illustrates in greater detail the spray gun and bead dispenser assembly as shown in FIG. 1, which is in accordance with one embodiment of the invention. The spray gun 24 is along the lines of a conventional hand held spray gun, and includes a body 56 having a handle 58 and a trigger 60 pivotally mounted to the body at 62. An inlet 64 to the gun couples with the paint supply line 42 for receiving paint under pressure, whereby upon movement of the trigger toward the handle and actuation of a valve stem 66 connected with the trigger, a fluid valve (not shown) within the gun is opened to emit paint through an orifice (also not shown) within a forward safety shield 68 to provide a fan-shaped spray of paint from the gun. To move the trigger toward the handle and actuate the gun, the cable 50 extends through a passage 70 in the handle and is connected with the trigger, whereby movement of the control lever by the operator pulls the trigger toward the handle.

In accordance with the one embodiment of the invention, the bead dispenser 48 comprises a hollow tube 72 received through a passage 74 in the gun handle 58 and secured therein by means of a set knob 76. An inlet end to the tube is provided with an adapter 78 for coupling with the line 46, whereby a supply of reflective glass beads under pressure is provided to the tube. A deflector 80 is coupled at 82 with an opposite or outlet end of the tube, and has a ramp surface 84 against which beads emitted from the tube are projected for deflection into the spray emitted from the gun. The position of the tube within the handle is adjustable to control the point at which beads are injected into the paint spray, thereby to control the width of the reflective stripe.

To control emission of reflective beads from the tube 72, a stopper valve 86 is movable over and away from the tube outlet. To this end, the stopper valve is carried at one end of a spring element 88, the other end of which is mounted at 89 on a bracket assembly 90 carried on the forward end of the tube. The bracket assembly includes a sleeve 92 through which the cable 52 extends, and the end of the cable is received in a passage in a sleeve 94 on the spring element and is secured therein by a set screw 96. Thus, upon actuation of the lever or levers by an operator, the cable 52 is retracted and moves the stopper valve away from the tube outlet to allow a supply of beads to be projected against the ramp surface 84 of the deflector 80 for deflection into the paint spray emitted from the gun. The beads become entrained within the spray and are carried to and deposited on the pavement in a stripe along with the paint, whereby a reflective stripe is applied on the pavement.

Figure 3:
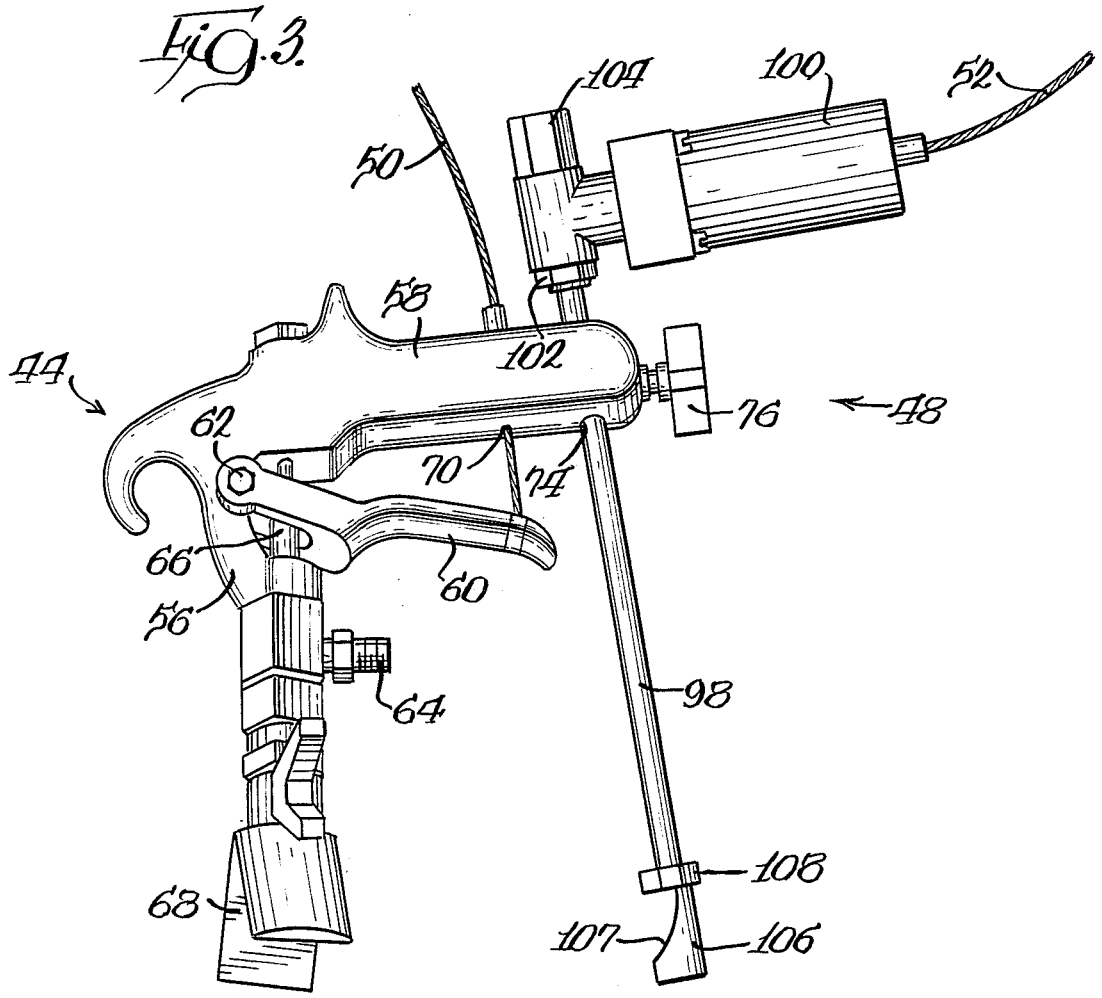
FIG. 3 is a side elevation view of a spray gun and bead dispenser assembly in accordance with another embodiment.

FIG. 3 illustrates another embodiment of spray gun and bead dispenser assembly in accordance with the present invention. In this case, the bead dispenser assembly 48 comprises a hollow tube 98 received within the passage 74 through the gun handle and secured therein by the set knob 76. A ball valve 100 is at an inlet end to the tube, and is connected with the cable 52 for being opened and closed thereby. The ball valve includes a fitting 102 for being connected with the tube inlet and a fitting 104 for connection with the bead supply line 46, whereby upon actuation of the cable and opening of the ball valve tiny, round and reflective glass beads are provided through the tube. A deflector 106 having a ramp surface 107 is connected with an opposite or outlet end of the tube by a coupler 108, whereby upon opening of the ball valve a flow of reflective beads through the tube is projected against the ramp surface for deflection into the paint spray emitted from the gun and deposit with the paint in a stripe on the pavement. As for the embodiment of FIG. 2, the position of the tube within the handle is adjustable to control the width of the reflective stripe applied on the pavement.

The invention thus provides improved spray gun and bead dispensing assemblies. Because the bead dispensers are mounted on the spray guns themselves, no additional hardware is required to support the same on the line striper, thereby reducing the complexity and cost of the structure. In addition, the bead dispensers themselves are extremely simple in structure, and essentially comprise only a hollow tube, a deflector for directing emitted beads into the paint spray and a valve for controlling a passage through the tube.

While embodiments of the invention have been described in detail, various modifications and other embodiments thereof may be devised by one skilled in the art without departing from the spirit and scope of the invention, as defined in the appended claims.

What is claimed is:

1. An improved spray gun and bead dispenser assembly for a paint striper, comprising an airless spray gun of the hand-held type having an inlet for connection with a supply of paint under pressure, a handle having a passage therethrough, a spray nozzle and a trigger for actuating said gun to emit a spray of paint from said nozzle; and a bead dispenser including a hollow tube extended through and secured in said handle passage, said tube having an inlet end for connection with a supply of reflective beads under pressure and an outlet end forwardly of said handle, valve means for controlling a flow of beads through said tube for emission from said outlet end, and a deflector means connected with said tube outlet end for deflecting beads emitted therefrom into a spray of paint from said spray gun for entrainment therein and deposit with said paint spray in a stripe on a surface.

2. An improved assembly as in claim 1, wherein said deflector means has a ramped surface positioned in front of said tube outlet for deflecting beads directed thereagainst into the paint spray.

3. An improved assembly as in claim 1, wherein said valve means is at said outlet end of said tube for opening and closing said outlet.

4. An improved assembly as in claim 1, wherein said valve means is connected in line between said tube inlet and the supply of beads under pressure.

5. An improved assembly as in claim 4, wherein said valve means comprises a ball valve.

6. An improved assembly as in claim 3, wherein said valve means comprises a stopper valve, and means mounting said stopper valve for movement between positions over and away from said tube outlet.

7. An improved assembly as in claim 6, wherein said mounting means comprises a bracket on said tube toward said outlet, a spring element connected between said bracket and said stopper valve for normally urging said stopper valve to said position over said tube outlet, and means coupled with said spring for moving the same in a direction to move said stopper valve to said position away from said tube outlet.

8. An improved assembly as in claim 7, wherein said means coupled with said spring for moving the same comprises a cable connected at an end thereof with said spring element, said cable extending through a passage in said bracket and being movable therein to pull said spring in a direction to move said stopper valve away from said tube outlet.

9. An improved assembly as in claim 1 or 8, wherein said spray gun handle has a second passage therethrough, and including a cable extended through said second passage and connected with said gun trigger, said cable being movable in said second passage to pull said trigger toward said handle to actuate said spray gun.

* * * * *